US005187823A

United States Patent [19]

Ferguson et al.

[11] Patent Number: 5,187,823

[45] Date of Patent: Feb. 23, 1993

[54] COMBINATION BLANKET AND TOTE BAG

[76] Inventors: Michael J. Ferguson; Stephen E. Paterson, both of 171 Centre Street, London, Ontario, Canada, N6J 1T7

[21] Appl. No.: 917,302

[22] Filed: Jul. 23, 1992

[51] Int. Cl.[5] ..... A47G 9/06; B65D 30/10; B65D 33/12

[52] U.S. Cl. ..... 5/417; 190/1; 224/153; 383/4; 383/38; 383/75

[58] Field of Search ..... 5/417–420; 383/4, 75, 38, 39, 40, 71, 72, 75, 127; 224/151, 153, 155; 190/1, 2

[56] References Cited

U.S. PATENT DOCUMENTS

| | | | |
|---|---|---|---|
| 1,681,922 | 8/1928 | Boch | 383/75 |
| 2,479,203 | 8/1949 | Brown | 5/417 |
| 2,552,443 | 5/1951 | Molinari | 224/151 |
| 3,738,545 | 4/1972 | Westgor | 5/417 |
| 4,337,812 | 7/1982 | Trinker | 383/4 |
| 4,674,664 | 6/1987 | Simon | 224/153 |
| 4,794,029 | 12/1988 | Tennant et al. | 5/417 |
| 4,856,912 | 8/1989 | Damus et al. | 383/4 |
| 4,991,978 | 2/1991 | Ostrowski | 5/417 |

FOREIGN PATENT DOCUMENTS

| | | | |
|---|---|---|---|
| 2627680 | 9/1989 | France | 5/417 |

*Primary Examiner*—Alexander Grosz
*Attorney, Agent, or Firm*—R. Craig Armstrong

[57] ABSTRACT

An article is disclosed which is capable of being configured as a blanket or mat or the like, or as a carrying bag or knapsack. The article is made of a fabric piece having two opposing arcuate fabric channel halves secured to the lower surface thereof, facing each other. The channel halves define a generally circular channel in the center of the fabric piece. Gaps between the opposing ends of the fabric channel halves expose at least one and preferably two separate continuous ropes which pass through the channel. The fabric piece has a generally circular central portion of smaller diameter than the channel, with at least one retaining loop secured near the circumference thereof. A carrying bag may be formed by folding those portions of the fabric piece which are outside the channel upwardly and in towards the center of the fabric piece, thereby exposing the ropes in the gaps, by then pulling the ropes to bunch the fabric channel halves thereon, and by then routing the pulled ropes through at least one retaining loop and tying them to define a carrying loop in the fashion of a shoulder strap. Where two ropes and two retaining loops are provided, a backpack configuration may be produced by securing one rope to each retaining loop, such that one rope goes over one shoulder, and the other rope goes over the other shoulder. Preferably, at least one pocket is provided on the underside of the fabric piece, outside the channels.

2 Claims, 9 Drawing Sheets

FIG. 9.
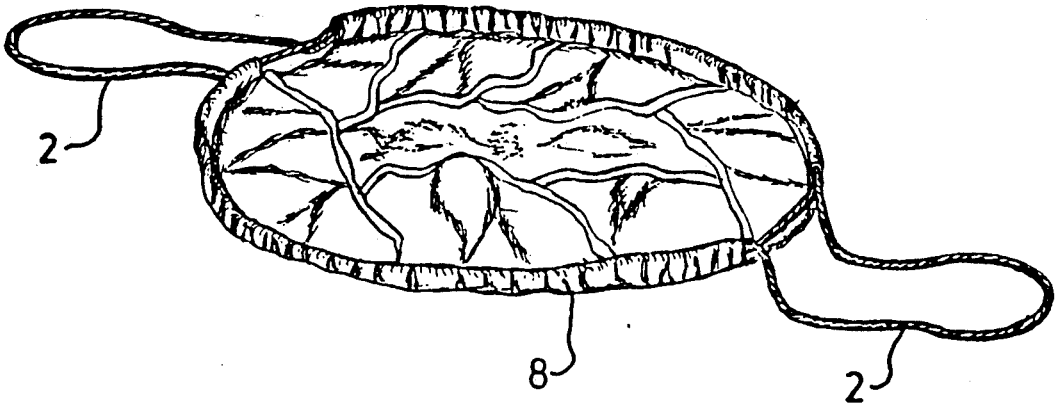
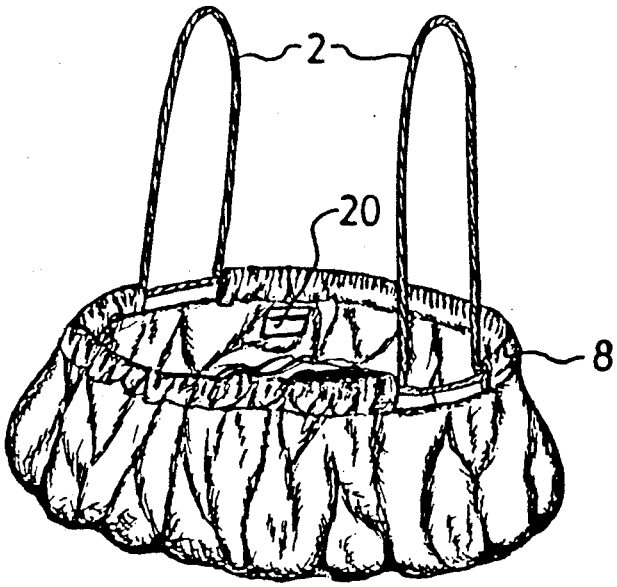
FIG. 10.

FIG.11.
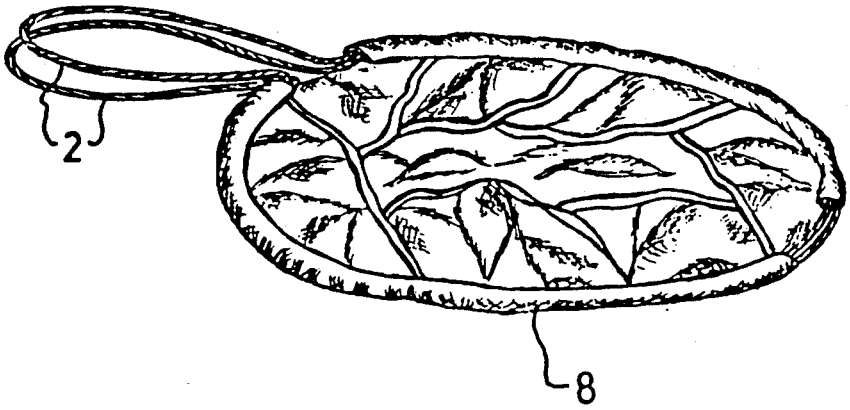
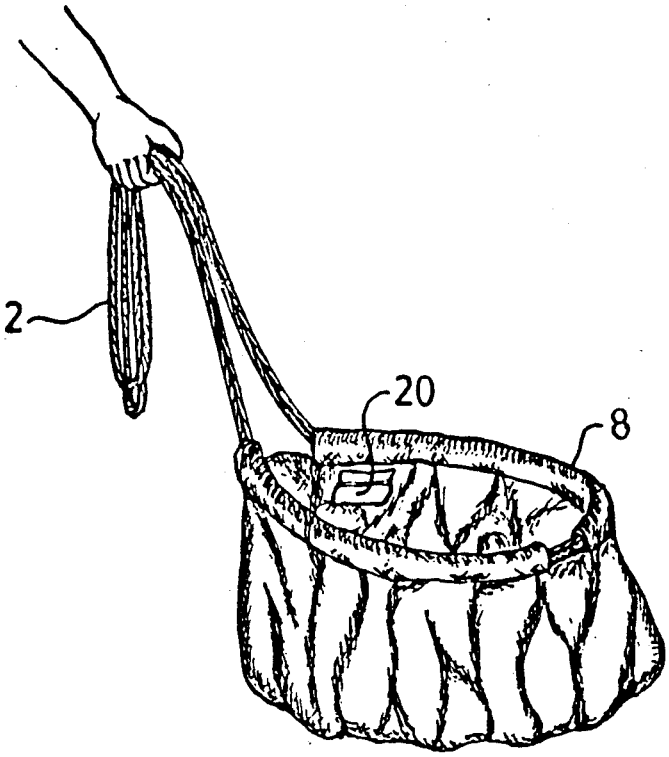
FIG.12.

COMBINATION BLANKET AND TOTE BAG

BACKGROUND OF THE INVENTION

1. Field of the Invention

This invention relates to an article which may be configured either as a beach blanket or the like, or as a carrying bag, knapsack or backpack. When spread out flat, the article acts as a blanket, but when pulled in via drawstrings, it acts as a bag. Routing the drawstrings through rings or loops permits a knapsack or backpack to be created.

2. Description of the Prior Art

U.S. Pat. No. 2,479,203 (Brown) discloses a "play mat" which has some similarity to the present invention. The Brown play mat may be laid flat, and then drawn into a carrying bag via a single drawstring, which is routed through a series of rings. However, there is no means for providing a knapsack or backpack configuration as in the present invention.

SUMMARY OF THE INVENTION

It is an object of the invention to provide an article which may be used as a mat or beach blanket or the like, and which may then be readily folded up and configured as a carrying bag or backpack, with a suitable carrying means.

It is a further object of the invention to provide such an article, having additionally advantageous features including storage pockets and other features to be described in greater detail below.

In the invention, there is a fabric piece having two opposing arcuate fabric channel halves secured to the lower surface thereof, facing each other and positioned in a distance from the outer edge of said fabric piece. The channel halves define a generally circular channel with the center of the circle corresponding generally to the center of the fabric piece. Gaps between the opposing ends of the fabric channel halves expose two separate ropes (or less preferably, one rope), each braided in the form of a continuous loop, the rope(s) passing through the channel. The fabric piece has a generally circular central portion of smaller diameter than the channel, with at least one and preferably four retaining loops secured near the circumference thereof. A carrying bag may be formed by folding those portions of the fabric piece which are outside the channel upwardly and in towards the center of the fabric piece, thereby exposing the rope(s) in the gaps, by then pulling the rope(s) to bunch the fabric channel halves thereon, and by then routing the pulled rope(s) through at least one retaining loop and tying it to define a carrying loop in the fashion of a shoulder strap.

Where two ropes and at least two retaining loops are provided, a backpack configuration may be produced by securing one rope to each retaining loop, such that one rope goes over one shoulder, and the other rope goes over the other shoulder.

More retaining loops may be provided, four for example, to provide greater flexibility as to which retaining loops to secure the rope(s) to, which is advantageous to facilitate balancing an uneven load.

Further features of the invention will be described or will become apparent in the course of the following detailed description.

DESCRIPTION OF THE DRAWINGS

In order that the invention may be more clearly understood, the preferred embodiment thereof will now be described in detail by way of example, with reference to the accompanying drawings, in which:

FIG. 9 is a perspective view, showing the first step in forming the bag, pulling the ropes from both sides;

FIG. 10 is a perspective view, showing the second step in forming the bag, pulling the ropes from both sides;

FIG. 11 is a perspective view, showing the first step in forming the bag, pulling the ropes from one side;

FIG. 12 is a perspective view, showing the second step in forming the bag pulling the ropes from one side;

DETAILED DESCRIPTION OF THE PREFERRED EMBODIMENT

Figure 1:
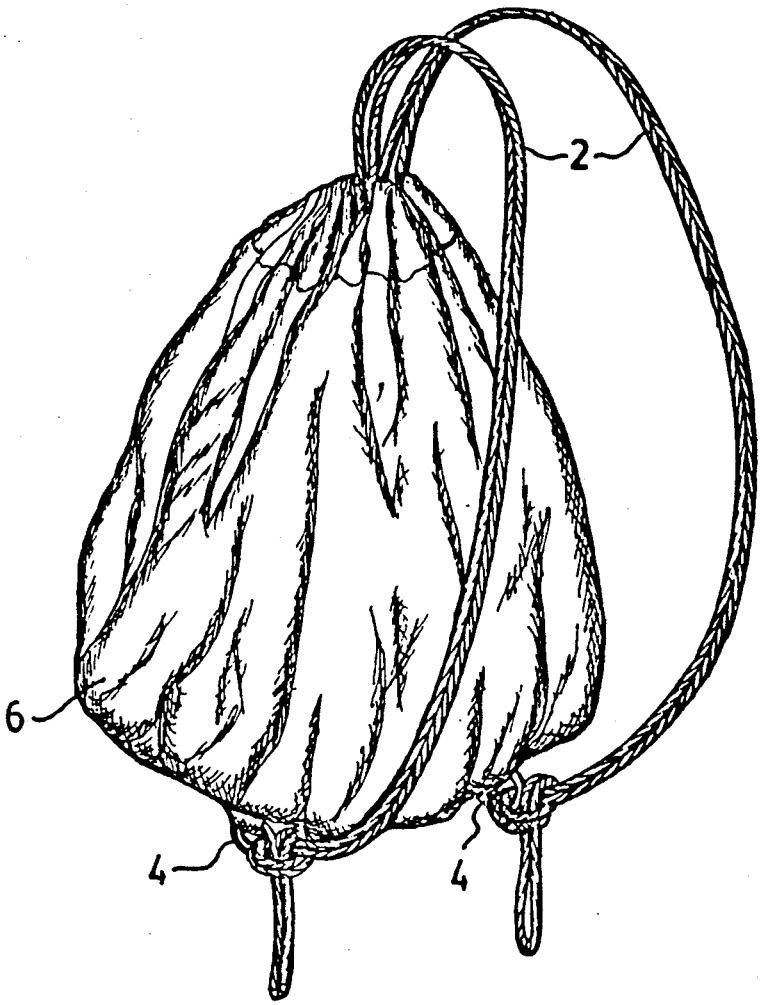
FIG. 1 is a perspective view of the article, configured as a backpack.
Figure 2:
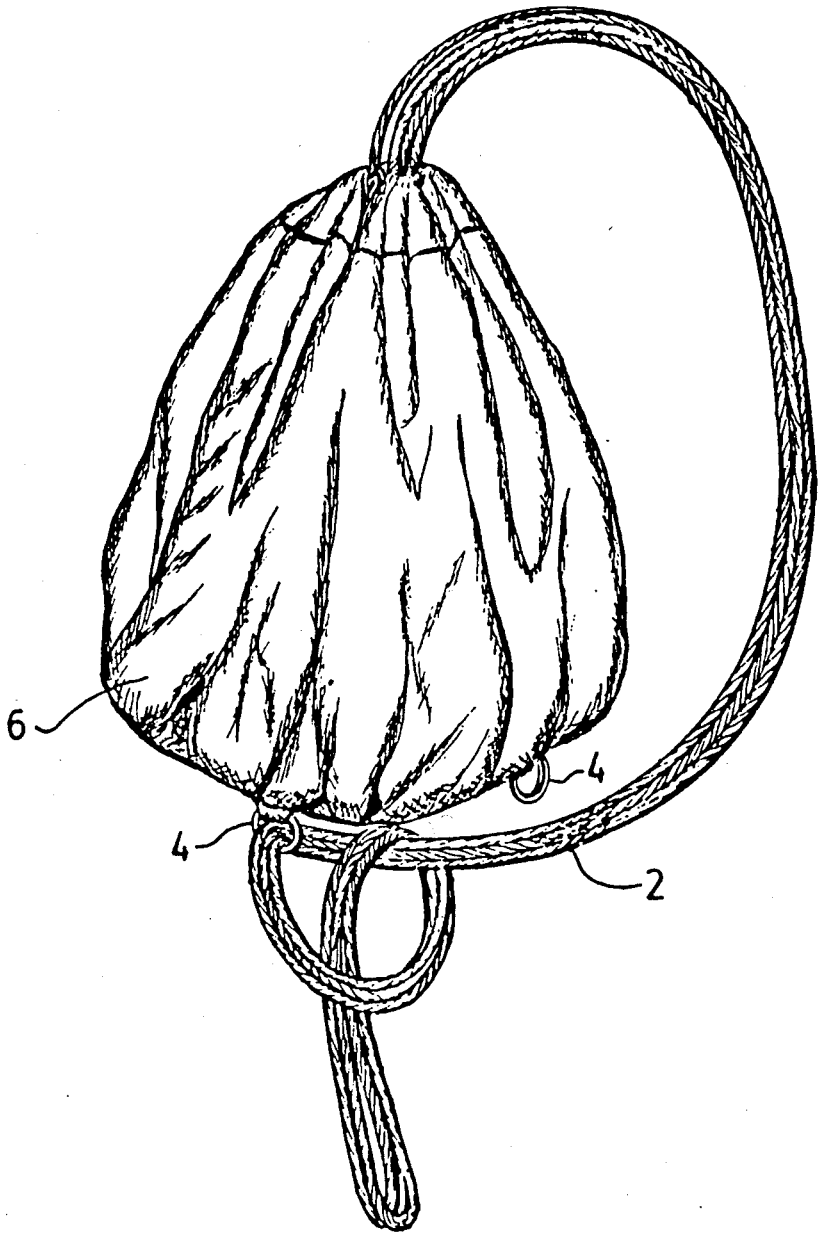
FIG. 2 is a perspective view of the article, configured as a bag with a shoulder strap.
Figure 3:
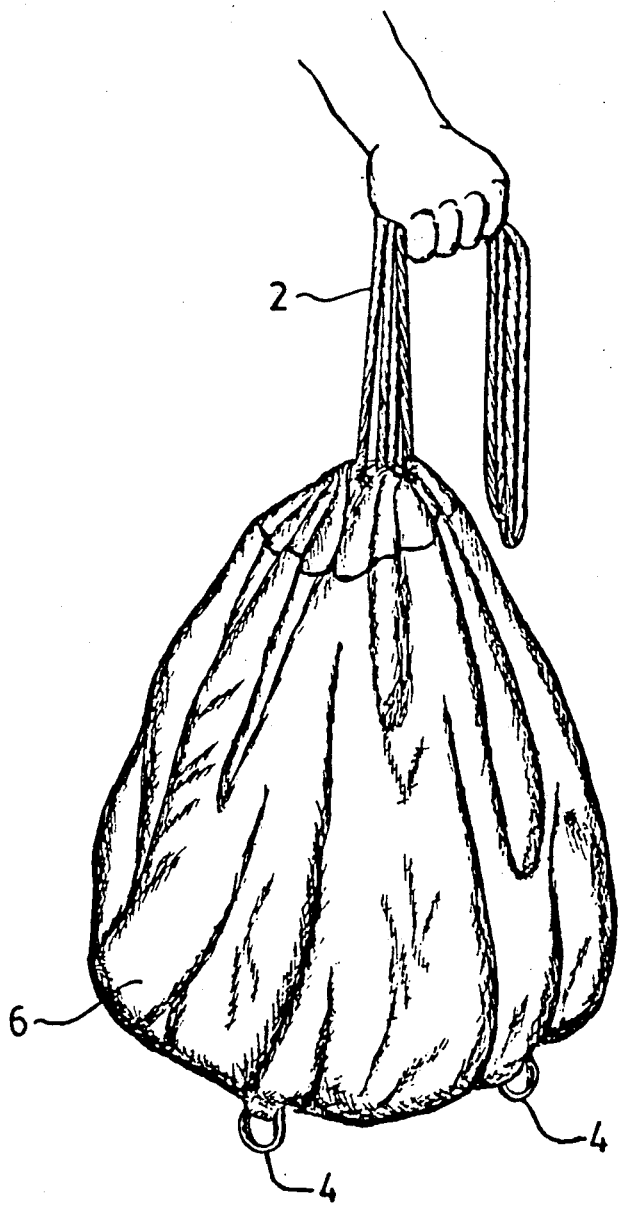
FIG. 3 is a perspective view of the article, configured simply as a bag with the ropes available for carrying.

Referring now to the drawings, FIG. 1 shows the article configured as a backpack, with two ropes 2, one going to each of two rings or retaining loops 4, and being tied thereto. One rope goes over one shoulder, and the other rope goes over the other shoulder. FIG. 2 is similar, illustrating that the user has the option of securing both ropes to just one of the rings or loops, to form a shoulder strap such that the bag can be easily carried by positioning the rope over one's shoulder. FIG. 3 illustrates the option of not using the rings or retaining loops at all, and simply carrying the bag using the ropes.

Figure 4:
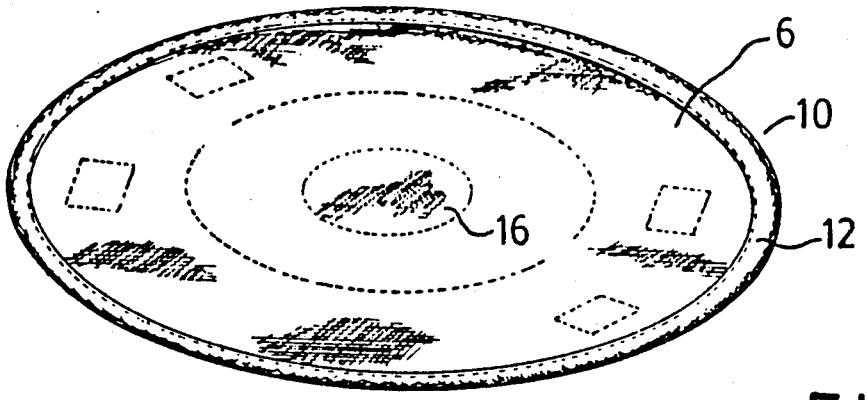
FIG. 4 is a perspective view of the article, laid out for use as a mat or blanket.
Figure 5:
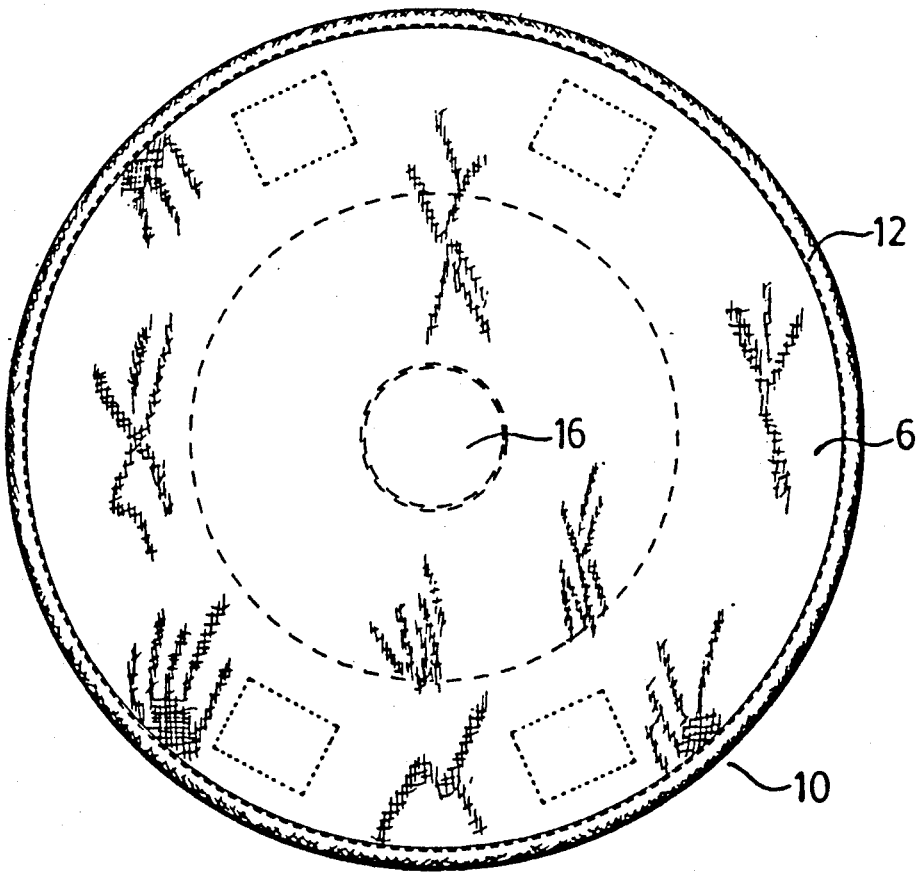
FIG. 5 is a top view of the article.
Figure 6:
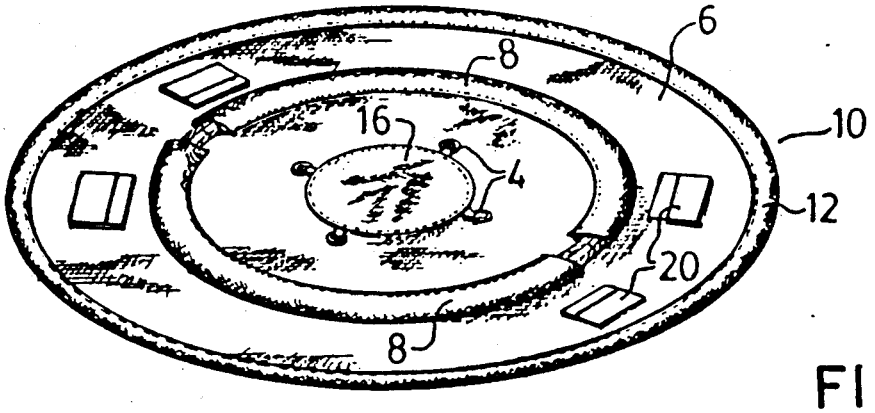
FIG. 6 is a perspective of the underside of the article.
Figure 7:
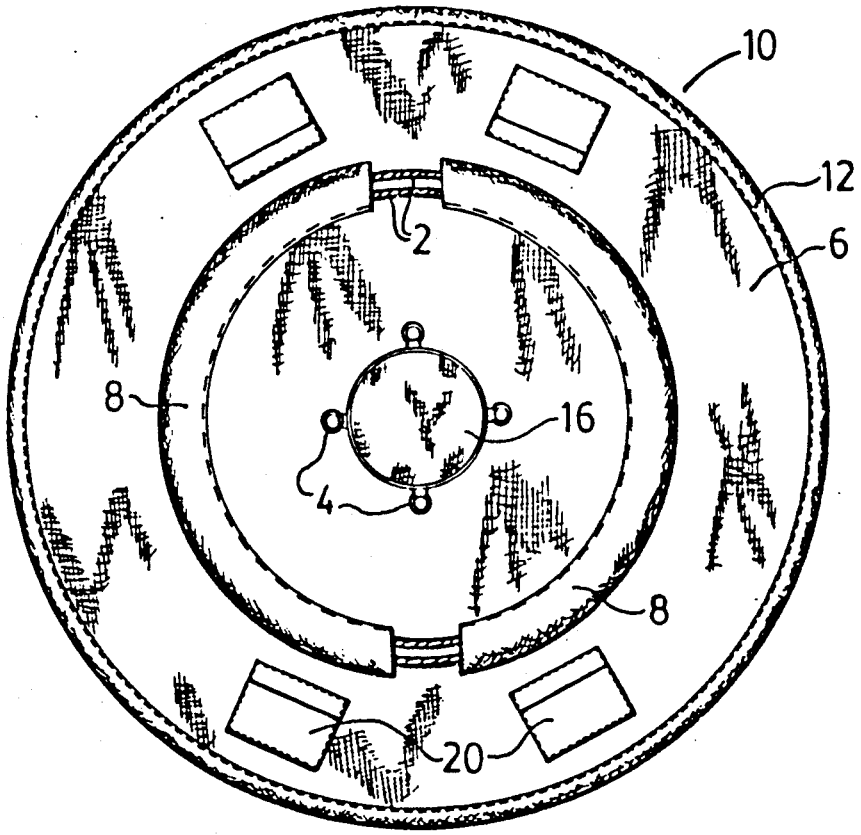
FIG. 7 is a bottom view of the article.

FIGS. 4 and 5 show the article, configured as a blanket or mat. FIGS. 6 and 7 show the underside of the article. The article is made from a piece of fabric 6, such as canvas, denim or some other flexible and reasonably sturdy material. A lightweight version could be made from ripstop nylon or the like, if desired, although heavier materials are generally more satisfactory, particularly for use as a blanket. The inventiveness of the article does not reside in the choice of materials.

Figure 8:
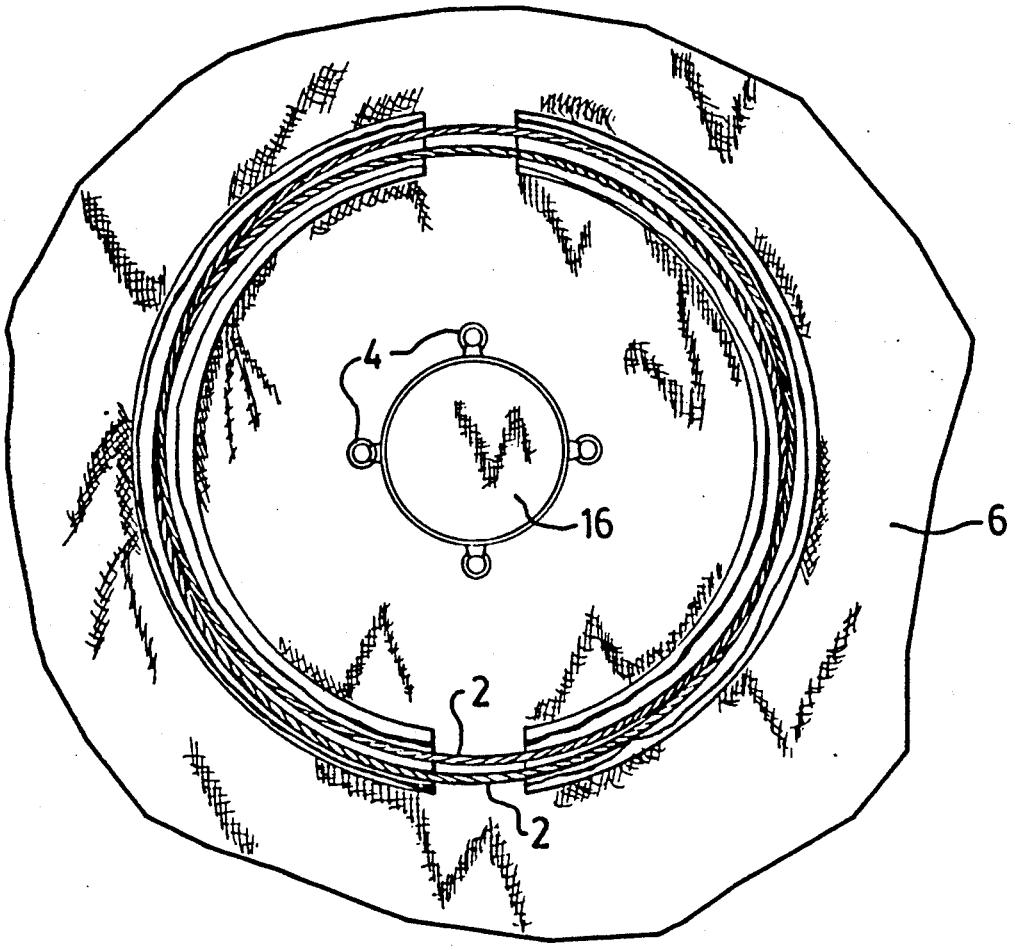
FIG. 8 is another bottom view, with the channel cut away to show the ropes.

The fabric piece 6 has two opposing arcuate fabric channel halves 8 sewn or otherwise secured to the lower surface thereof, facing each other and positioned in a distance from the outer edge 10 of the fabric piece. The outer edge has a hem 12 of binding tape or the like sewn thereto. The channel halves define a generally circular channel with the center of the circle corresponding generally to the center of the fabric piece. Each channel half is preferably formed from a sleeve of material, and sewn to the fabric piece 6 along one edge, e.g. the inner edge. Gaps between the opposing ends of the fabric channel halves expose at least one and preferably two separate continuous ropes 2 which pass through the channel, as seen best in FIG. 8.

The fabric piece has a generally circular central portion 16 of smaller diameter than the channel, which may be of more durable material than the rest of the piece, if desired, since it defines the bottom of the bag. At least one retaining loop 4, and preferably at least two and ideally four, is secured near the circumference of the central portion. Having four loops, for example, provides greater flexibility as to which retaining loops to secure the ropes to, so that an uneven load can be better balanced, or so that an object with a hard edge can be carried without that edge necessarily digging into one's back.

The retaining loops may be metal or plastic rings as illustrated in the drawings, but preferably are cloth loops, so that when one is sitting on the blanket, there is nothing hard and uncomfortable to sit on.

As illustrated in FIGS. 9 and 10, a carrying bag may be formed by folding those portions of the fabric piece which are outside the channel upwardly and in towards the center of the fabric piece, thereby exposing the ropes 2 in the gaps, and by then pulling the ropes to bunch the fabric channel halves thereon. The pulled ropes can then be routed through at least one retaining loop 4 and tied, to produce the configurations of FIGS. 1 or 2.

Alternatively, as illustrated in FIGS. 11 and 12, the bag may be formed by pulling both ropes out from one gap location, although this is not quite as effective or simple to do. The ropes can still be secured to one or more retaining rings as before, to provide the FIG. 1 and FIG. 2 configurations, although in this case both ropes would be coming out of the bag at the same location, as opposed to being spaced apart by 180 degrees.

Preferably, at least one pocket 20 is provided on the underside of the fabric piece, outside the channels. Thus when the article is being used as a blanket, the pocket(s) is/are on the underside and therefore not readily visible or accessible to thieves. In the preferred embodiment as illustrated, four such pockets are provided. When the outer portions are folded in to form the bag, the pockets are on the inside of the bag, again for security against theft. Preferably, the pockets are located close to the gaps, so that they can be located more easily by the user, i.e. by reaching into the bag just next to the gap location. The pockets could be closable via a zipper, but preferably that is avoided by using a reclosable fastener such as Velcro (trademark) hook and pile fastening material, or by having flaps which overlap each other.

It will be appreciated that the above description relates to the preferred embodiment by way of example only. Many variations on the invention will be obvious to those knowledgeable in the field, and such obvious variations are within the scope of the invention as described and claimed, whether or not expressly described.

For example, while there are two independent ropes in the preferred embodiment, one rope could be used, although it is not as effective. With two ropes, pulling the ropes closes the bag essentially automatically. With only one rope, the bag is not as easy to close, since more handling of the material is required in order to bunch it together to form the bag. Also, in order to provide a backpack configuration, the rope would have to be pulled out evenly from both gaps, which is somewhat awkward to do if there is only one rope.

Figure 13:
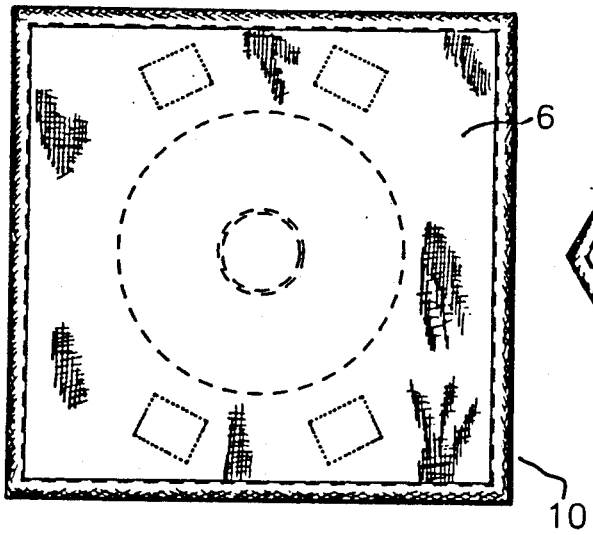
FIGS. 13, 14 and 15 are top views showing alternative outer shapes.
Figure 14:
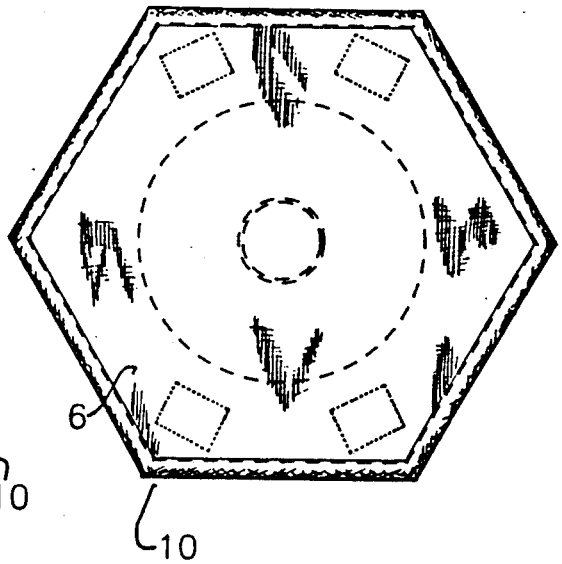
Figure 15:
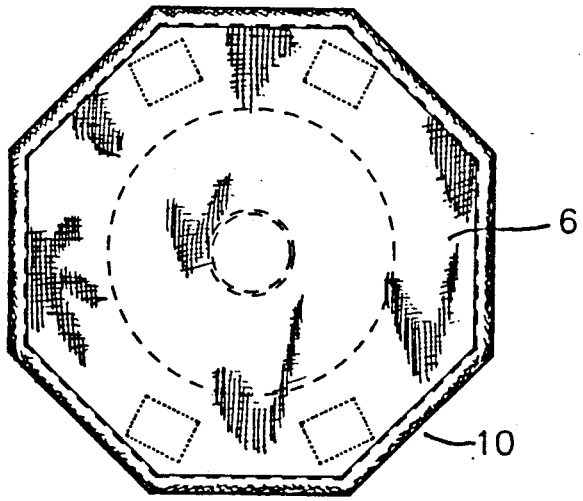

It should also be appreciated that the external shape of the article could be readily varied. FIGS. 13, 14 and 15 provide examples of alternative shapes.

Furthermore, it should be appreciated that the channel need not be exactly circular.

What is claimed as the invention is:

1. A combination blanket and carrying bag comprising:

a fabric piece having an upper surface and a lower surface and an outer edge;

two opposing arcuate fabric channel halves secured to said lower surface, facing each other and positioned in a distance from the outer edge of said fabric piece and defining a generally circular channel with the center of a circle enclosed by the circular channel corresponding generally to the center of the fabric piece, said circular channel having opposing gaps therein between opposing ends of said fabric channel halves;

two continuous ropes passing through said channel, being exposed at said gaps;

a generally circular central portion of said fabric piece, having at least two retaining loops located at the circumference thereof and spaced apart from each other around the circumference and secured to said lower surface;

whereby a carrying bag may be formed by folding those portions of said fabric piece which are outside said channel upwardly and in towards the center of the fabric piece, thereby exposing said two ropes in said gaps, by then pulling said two ropes to bunch said fabric channel halves thereon, and by then routing said pulled ropes through two of said at least two retaining loops and tying said ropes to said retaining loops to define two carrying loops, with one carrying loop adapted to go over one shoulder of a person, and the other carrying loop adapted to go over the other shoulder of the person, whereby the combination blanket and carrying bag can take on a backpack configuration.

2. A combination blanket and carrying bag as recited in claim 1, further comprising at least two pockets provided on the lower surface of said fabric piece between the location of said channel and said outer edge.

* * * * *